US005687991A

United States Patent [19]

Gairdner

[11] Patent Number: 5,687,991

[45] Date of Patent: Nov. 18, 1997

[54] METHOD AND APPARATUS FOR BRAKING SKATES AND THE LIKE

[76] Inventor: James R. Gairdner, 77 Clarendon Ave., Ste. 501, Toronto, Ontario, Canada, M4V 1J2

[21] Appl. No.: 518,343

[22] Filed: Aug. 23, 1995

[51] Int. Cl.[6] ..... A63C 17/28

[52] U.S. Cl. ..... 280/826; 280/11.2; 280/819; 135/85

[58] Field of Search ..... 135/85; 280/809, 280/821, 816, 78, 47.3, 47.32, 11.2, 819, 826

[56] References Cited

U.S. PATENT DOCUMENTS

| | | | |
|---|---|---|---|
| 1,817,882 | 8/1931 | Elliotte | 280/47.3 |
| 2,379,426 | 7/1945 | Edstrom | 280/47.3 |
| 2,445,942 | 7/1948 | Dusinberre . | |
| 3,948,535 | 4/1976 | Negi | 280/816 |
| 4,194,751 | 3/1980 | Shinmura . | |
| 4,456,089 | 6/1984 | Kuwahara . | |
| 4,943,075 | 7/1990 | Gates . | |
| 4,962,781 | 10/1990 | Kanbar . | |
| 5,106,110 | 4/1992 | Williamson . | |
| 5,312,135 | 5/1994 | Karabees . | |
| 5,330,207 | 7/1994 | Mitchell . | |
| 5,374,070 | 12/1994 | Pellegrini, Jr. et al. . | |

FOREIGN PATENT DOCUMENTS

| | | |
|---|---|---|
| 0106517 | 4/1984 | European Pat. Off. . |
| WO 94/21340 | 9/1994 | WIPO . |

OTHER PUBLICATIONS

Article entitled "Heel, Boy" from Inline 1995 Aug./Sep., p. 20.

*Primary Examiner*—Brian L. Johnson
*Assistant Examiner*—Avraham Lerner
*Attorney, Agent, or Firm*—Bereskin & Parr

[57] ABSTRACT

Method and apparatus for braking a person wearing wheeled skates such as in-line skates, in which an elongated shaft has an arm clamp attached at its upper end to grip the user's arm, and a wheel rotatably connected to its lower end. A hand grip and braking handle near the upper end of the shaft can be grasped by the user's hand to activate a wheel braking mechanism. In use the shaft is attached to the user's arm and extends forwardly and downwardly from the arm, so that when braking is to occur, the user triangulates forwardly onto the shaft which supports the user's weight against falling and provides braking.

8 Claims, 7 Drawing Sheets

METHOD AND APPARATUS FOR BRAKING SKATES AND THE LIKE

FIELD OF THE INVENTION

This invention relates to method and apparatus for braking wheeled skates and the like. It is particularly suitable for in-line skates but can also be used for other types of roller skates, and if desired for similar types of equipment, e.g. wheeled skate-skis.

BACKGROUND OF THE INVENTION

Conventional roller skates have been widely available for many decades. There has never been a satisfactory way of braking conventional roller skates, but since the speeds achieved by most roller skaters were not particularly high, the incidence of injuries resulting from conventional roller skate use was relatively modest.

However over about the last ten years, in-line roller skates have become increasingly popular. Persons using in-line roller skates are easily able to achieve relatively high speeds, as a result of which the need for adequate braking has become of much greater importance. Unfortunately no adequate method of braking persons using these skates has yet been developed, as a result of which their use has resulted in an unacceptably high incidence of broken wrists and other injuries.

Various approaches have been taken to braking in-line roller skates. The most common approach, and that currently used on most in-line skates, is to provide a braking pad at the rear of one boot of the skate. When the user wishes to stop, he or she is supposed to move the braking foot forwardly and tilt it rearwardly to drag the brake pad on the ground, to slow the skater. In another version the toe is held down and the cuff is angled to cause a lever to push a rear brake pad against the ground. In either case the motion is counter intuitive and at best can only decelerate the user gradually. In an emergency, where one or both skates encounter an obstacle (such as sand, gravel or grass on the road or even a very rough surface) and the wheels stop turning, the user's center of gravity moves forwardly of the skates; it becomes impossible to adopt the normal braking stance, and a fall becomes highly likely.

Various other attempts have been made to provide brakes for in-line skates and the like. For example, as shown in U.S. Pat. No. 4,943,075, brakes have been fitted to operate on the wheels themselves. An obvious problem with this approach is that if the wheels are braked, then the skates may stop but the body of the person using them will continue to move forwardly, lifting the wheels off the ground and nullifying the braking action. The person will likely then fall.

A different approach is shown in U.S. Pat. No. 5,312,135. That patent shows an elongated shaft having a brakable wheel at each end. The skater carries the shaft in both hands and its use requires that the skater lean backwards into a semi-sitting position, using the shaft as a rearwardly extending support, and then apply the brake. A major problem with this device is that again, if the skates encounter an unexpected obstacle and suddenly stop (unfortunately an all too common occurrence), the skater will not have time to lean backward into a sitting position and apply the brake. Instead, the user's body will be thrust forwardly of the skates and a crash will result. If the user is able to lean backward and brake the rearwardly trailing wheel, his/her skates will tend to move forwardly in front of the user, again causing a fall.

SUMMARY OF THE INVENTION

Accordingly, the present invention provides a method and apparatus for braking a person wearing wheeled skates (such as in-line skates).

In one aspect the invention provides a device for supporting and braking a skater, said device comprising:

(d) an elongated body having an upper end and a lower end, (e) a wheel rotatably connected to said lower end, (f) braking means associated with said wheel for braking said wheel, (g) arm securing means located adjacent said upper end of said body for securing the skater's arm to said body, (h) hand grip means located below said arm securing means and adapted to be gripped by the user's hand, (i) brake lever means located proximate said hand grip means and operable by said user's hand for activating said braking means; and said body has an upper portion having said upper end, a lower portion having said lower end, and a central portion connecting said upper and lower portions, said upper and lower portions being substantially parallel to each other as viewed from the front and said central portion being inclined with respect to said upper and lower portions and forming an S-shape therewith, so that, when said upper portion is secured to said skater's arm, said inclined central portion extends inwardly toward the centre of the skater's body to position said wheel between the sides of the skater's body.

Further aspects of the invention will appear from the following description, taken together with the accompanying drawings.

DETAILED DESCRIPTION OF PREFERRED EMBODIMENTS

Reference is first made to FIGS. 1 to 8, which show a skate braking device 10 according to the invention, in use by a skater 12 wearing in-line skates 14.

Figure 2:
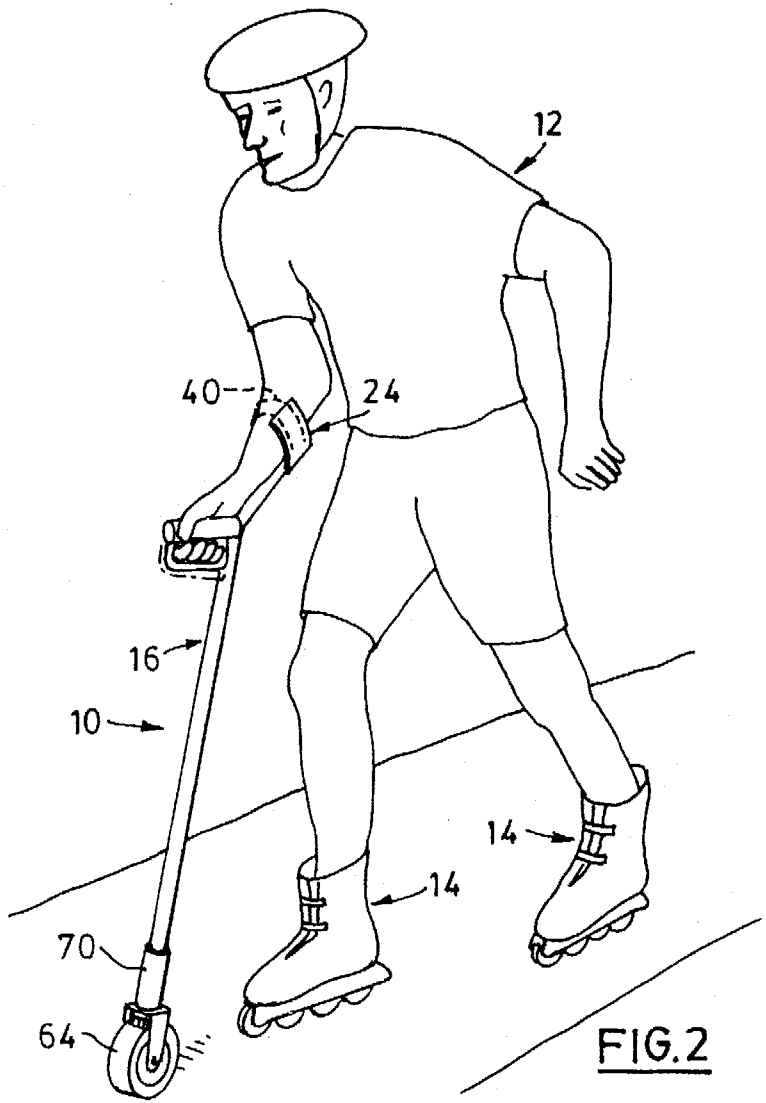
FIG. 2 is a perspective view similar to that of FIG. 1 device, with light braking occurring.
Figure 1:
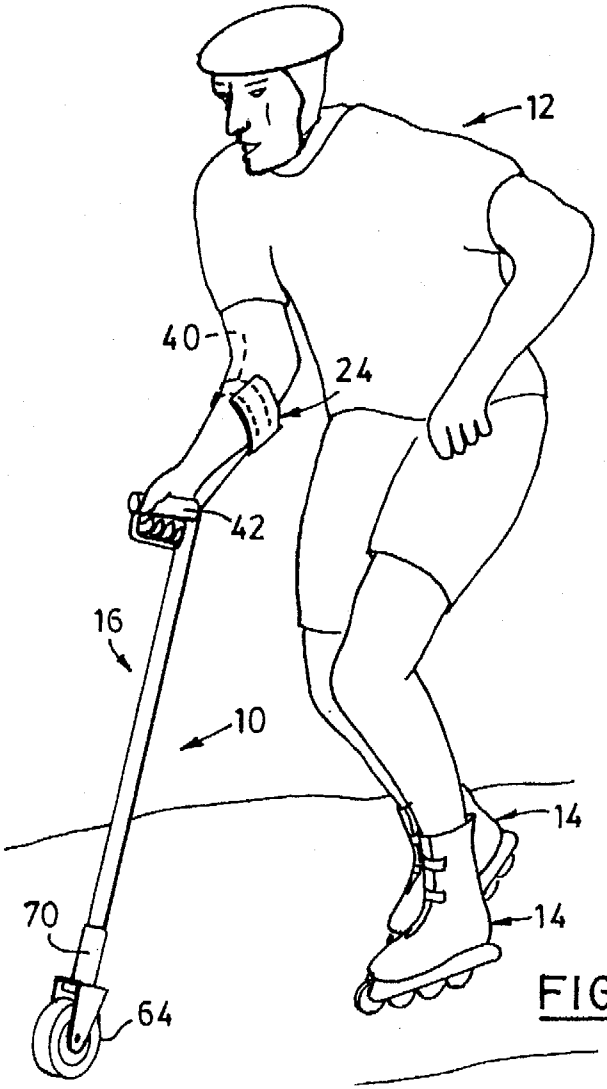
FIG. 1 is a perspective view of a braking device according to the invention and in use in normal skating.
Figures 3, 3A:
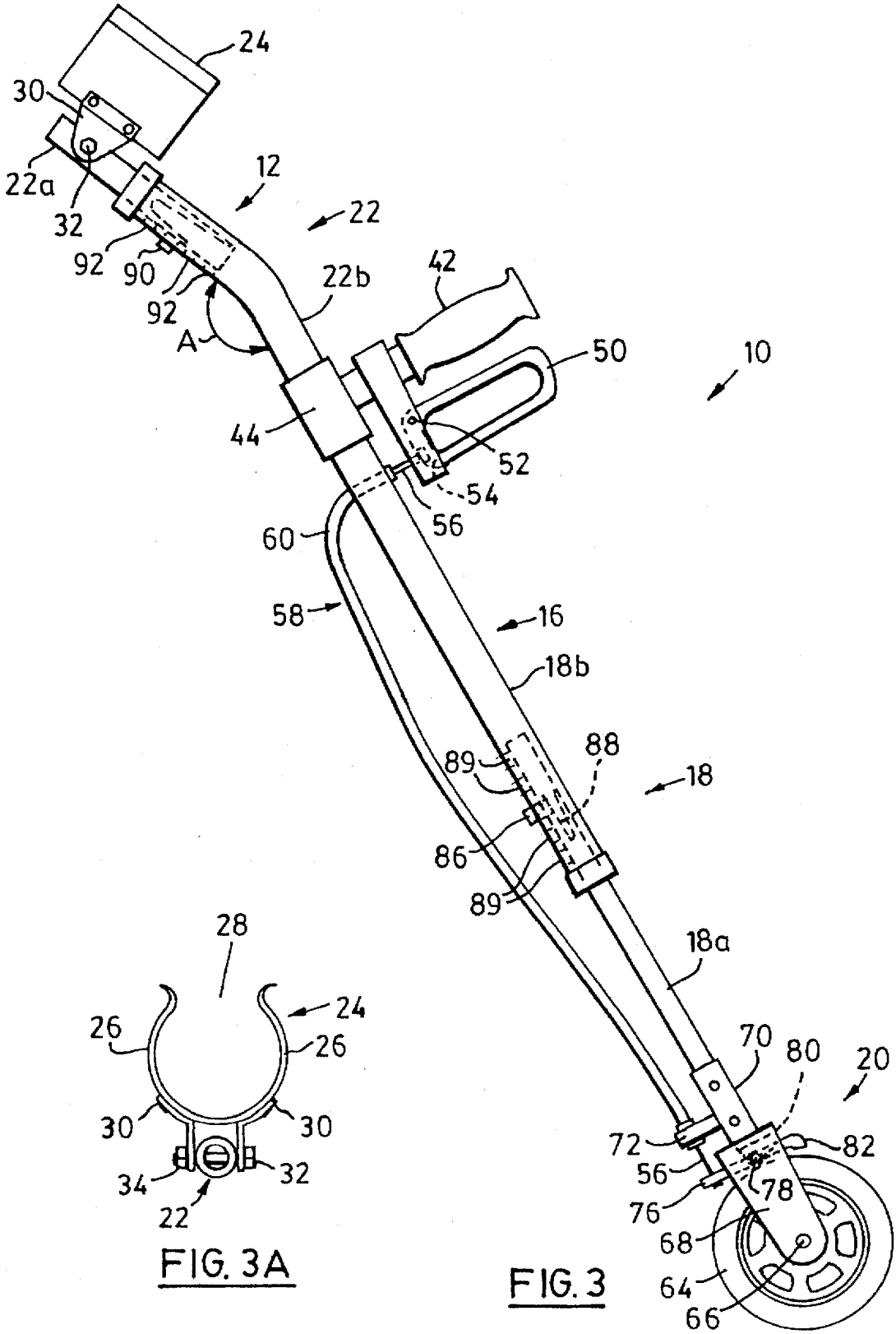
FIG. 3 is a side view of a braking device according to the invention.
FIG. 3A is an end view of an arm holder of the FIG. 3 device.
Figure 4:
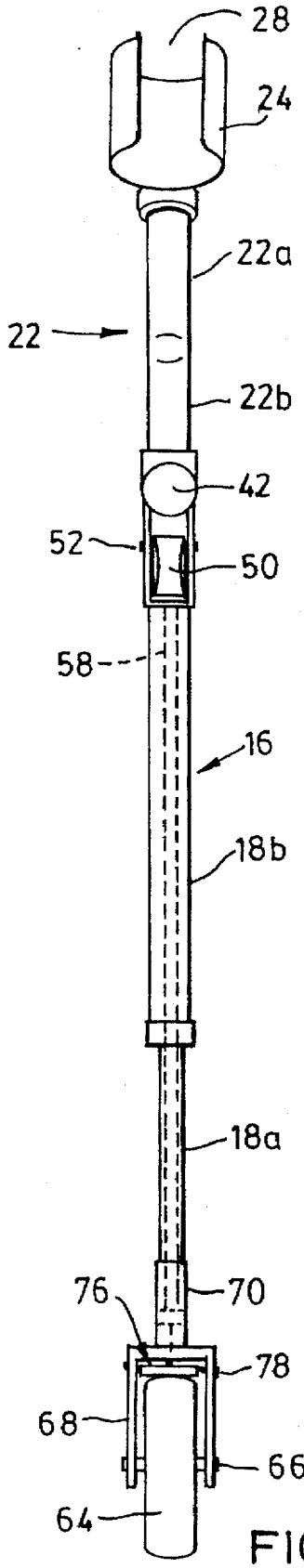
FIG. 4 is a front view of the FIG. 1 device.

As best shown in FIGS. 3, 3A and 4, the device 10 includes a shaft 16. The shaft 16 is typically a hollow tube formed of aluminum, plastic, graphite or other light strong material suitable for resisting substantial forces. The shaft 16 has a lower portion 18 which carries a wheel assembly 20, and an upper portion 22 which carries a C-shaped clamp or arm holder 24. The arm holder or clamp 24 (see FIG. 3A) faces upwardly and forwardly in use and is generally C-shaped, having a pair of opposed arcuate sides 26 and an opening 28 between its sides to receive the user's forearm (as shown in FIGS. 1 and 2). The arm holder 26 is connected (e.g. by rivets) to two L-shaped supports 30 which are connected to the upper shaft portion by a bolt 32 and nut 34. This allows a small degree of rocking of arm holder 24 about bolt 32, to allow some movement of the user's arm.

A strap 40, e.g. containing VELCRO (trade mark) is shown in dotted lines in FIGS. 1 and 2 as being wrapped around the arm holder 24 and the user's forearm to secure the upper part of the user's forearm securely to the upper part 22 of the shaft 16. (The strap 40 can be dispensed with if the arm holder 24 receives and holds the forearm relatively securely.)

In the embodiment shown there is an angle A between the upper and lower shaft portions 22, 18, but depending on the orientation in which the user prefers to hold his/her arm, the angle A can be changed or eliminated (i.e. made 180°).

A handle 42 projects forwardly and upwardly from the top of the lower portion 18 of the shaft 16. The handle 42 can be formed integrally with the shaft or (as shown) may have a separate collar 44 which is adhered, glued or riveted to the shaft 16. The handle 42 is positioned so that it can be gripped by the user's hand in use.

As best shown in FIG. 3, a brake lever 50 is pivoted at 52 to the handle 42. One end 54 of the brake lever 50 is connected to the inner wire 56 of a conventional coaxial brake cable 58 having an outer jacket 60. The outer jacket 60 is fixed to the shaft 16.

The brake cable 58 extends down to the wheel assembly 20. As shown, the wheel assembly 20 is conventional and includes a soft rubber tired wheel 64 rotatably mounted on axle 66 extending across a fork 68. Fork 68 extends downwardly from a tubular collar 70 which receives and is bolted to the lower end of shaft 16. The brake cable outer jacket is fixed to its lower end to a support 72 extending from collar 70. The inner brake wire 56 extends downwardly past support 72 and is connected by any suitable means to one end of a brake pad 76.

The brake pad 76 is pivotally mounted by shaft 78 on the fork 68. A coil spring indicated in dotted lines at 80 and extending around shaft 78 biases the brake pad 76 to its normal position shown in FIG. 3, in which the tip 82 of the brake pad 76 is held out of contact with the wheel 64. When the user pulls the brake handle upwardly as drawn in FIG. 3, the brake pad rotates clockwise as drawn in FIG. 3 to bring the brake pad tip 82 into contact with the wheel 64, braking the wheel.

The entire wheel and braking assembly shown is conventional and is available from commercial sources such as the Dolomite Company (who produce the same for walkers) with a distribution office in Toronto, Ontario, Canada.

Preferably, but not necessarily, the lower portion 18 of shaft 16 is made telescopic, utilizing an inner tube **18*a* which can slide inwardly and outwardly from outer tube 18*b*. A button 86, biased outwardly by a spring 88, can be located in any one of a series of holes 89 in the outer tube 18*b***, to adjust the length of the outer tube to suit the height of the person using the braking device.

Similarly, the upper portion 22 of the shaft 16 may be made telescopic by mounting the arm holder 24 on an inner tube **22*a* which slides inwardly and outwardly from the outer tube 22*b* (which is integral with tube 18*b*). Again the position of these two tubes may be fixed by a spring biased button 90 which can extend through any of a series of holes 92 in the outer tube 22*b***. This adjusts the length of the upper portion of the device to the user's forearm.

Figure 5:
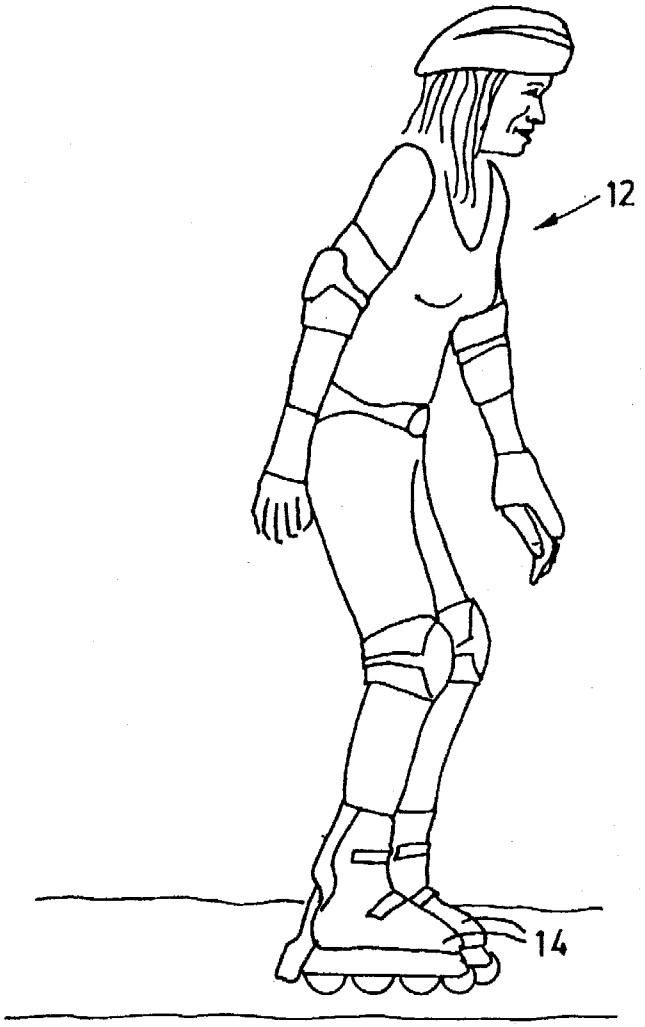
FIG. 5 is a side view showing an in-line skater in typical beginner stance.

The operation of the braking device 10 is as follows. As shown in FIG. 5, a beginner skater 12 normally positions himself/herself in a position so that his/her center of gravity is over the skates 14. As the skater then moves forwardly, his/her center of gravity moves forwardly since as is well known, normal walking or skating motion is a form of controlled fall, in which a person thrusts off with a rear foot, moving a front foot forwardly to catch the "fall" and repeating the process.

Figure 6:
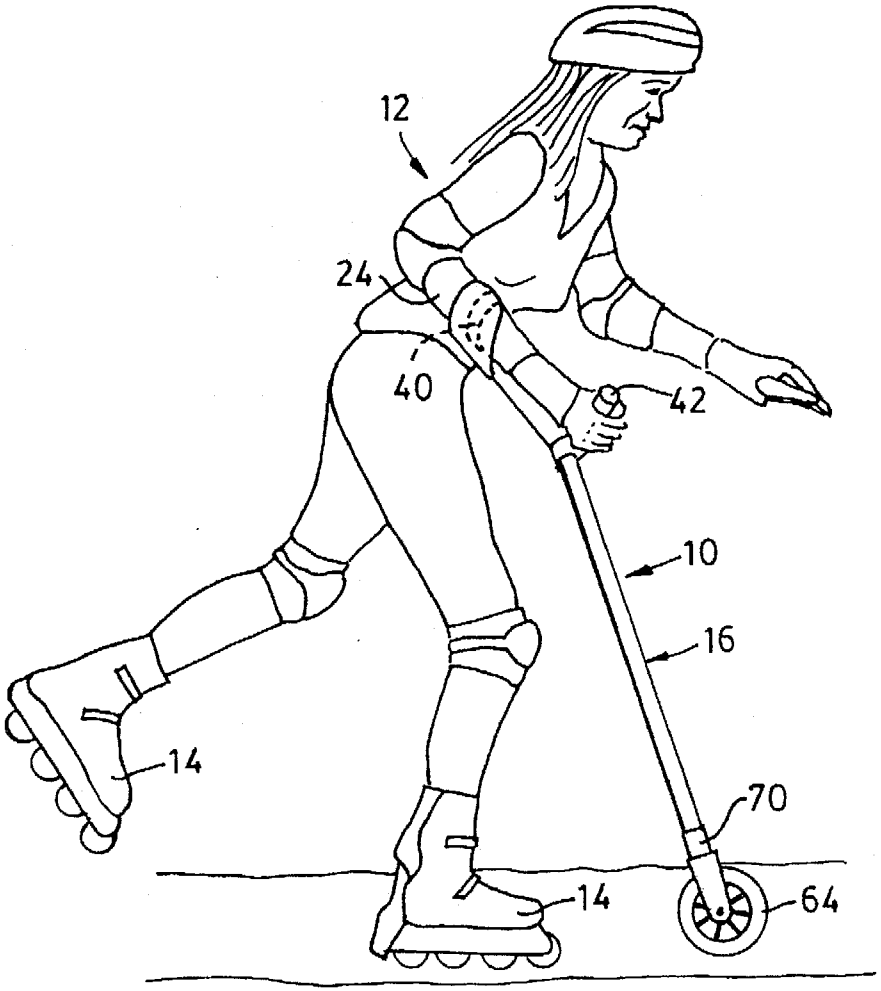
FIG. 6 is a side view showing a skater using the braking device of FIGS. 1 to 5 according to the invention.

When the device 10 is used, the skater assumes the typical stance shown in FIGS. 1 and 6. The arm holder 24 is secured to the user's forearm, and the user's hand grasps handle 42 with his/her fingers normally extending around the upper part of brake lever 50, ready to pull the brake lever if necessary. The user leans forwardly in a normal stance (FIGS. 1 and 6), usually with little or no weight placed on device 10 (though it can be used as a support if desired) and with the device 10 held in front of the user by a slightly forwardly extended forearm. As shown, the device 10 extends forwardly and downwardly from the user's forearm, forming a type of triangle the sides of which include the shaft 16 and wheel 64, and the user's arm, body and legs (and the ground). When the user is leaning forwardly in normal skating, his/her center of gravity is usually slightly ahead of the user's hips but will be rearwardly of the handle 42.

If a slow stop is required, the user simply uses his/her hand to pull the braking lever 50 toward handle 42 (FIGS. 2 and 7), slowing the wheel 64 to bring the skater to a stop. During slow braking, the user's center of gravity will shift forwardly slightly, bringing additional weight to bear on the shaft 16 and wheel 64. The device 10 however acts as a support, preventing the skater from falling forwardly. In effect the skater "triangulates" on the device 10, i.e. the leg of the previously described triangle formed by device 10 now carries a portion of the user's weight.

Figure 8:
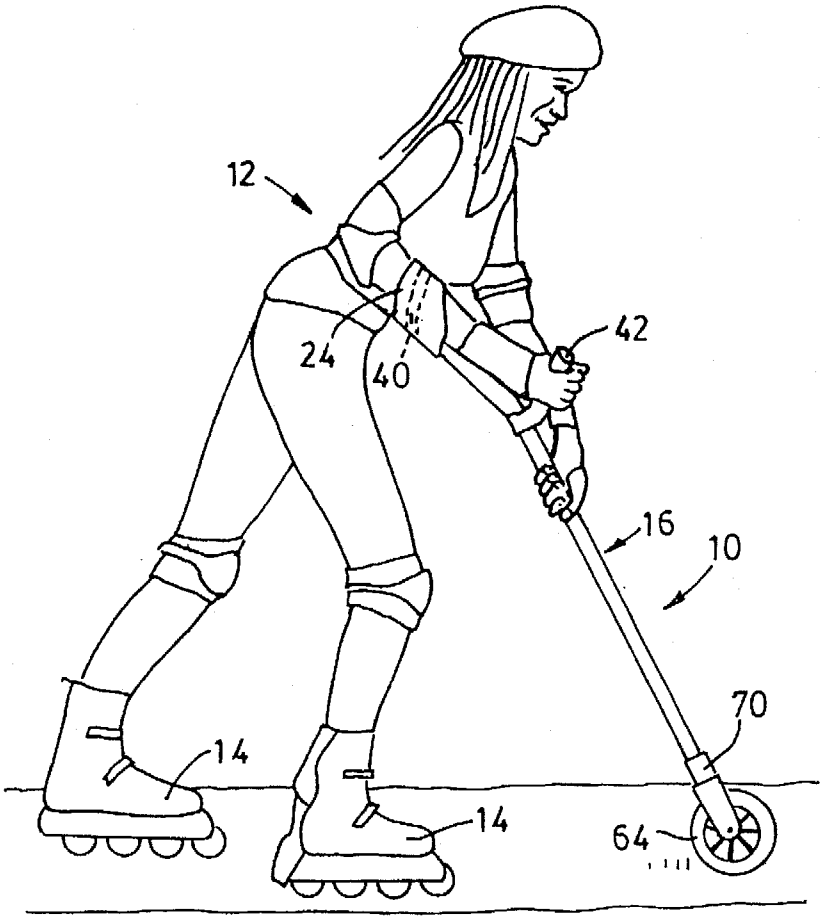
FIG. 8 is a side view similar to that of FIG. 7 but showing hard braking using the FIGS. 1 to 5.
Figure 7:
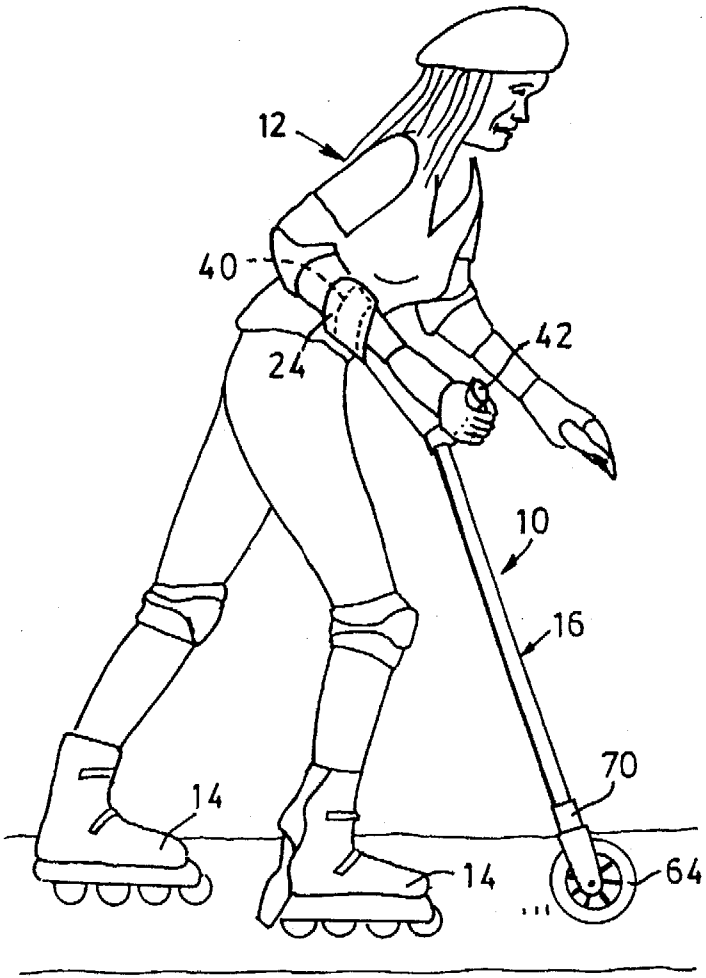
FIG. 7 is a side view similar to that of FIG. 6 but showing light braking using the FIGS. 1 to 5 device.

If emergency braking is required, e.g. if an obstacle is seen, or if the user's skates suddenly stop (because of gravel, sand or the like on the road), the user firmly pulls the brake lever 50. The user's dynamic center of gravity then rapidly shifts forwardly, as will be evident from FIG. 8. Ordinarily in a situation such as this, a serious fall would be almost inevitable. Indeed the act simply of braking rapidly will thrust the user's center of gravity forwardly, tending to cause a fall. However with the device 10, the shaft 16 and wheel 64, which extend forwardly and downwardly, again act as a support to bear the user's forwardly shifted weight and prevent a fall. At the same time, the braking forces exerted by the wheel 64 rapidly stop the user. The additional weight transmitted through shaft 16 to wheel 64, as the user's center of gravity shifts forwardly, helps to make the braking even more effective. It is also instinctive as shown in FIG. 8, for the skater to swing his/her free hand around to grasp the shaft 16 below handle 42, during the hand braking process. This offers additional support against falling. In this process the user effectively forms a tripod with the device 10, with two legs of the tripod being formed by the user's legs, and the third leg of the tripod being formed by the user's arms and by the shaft 16 and wheel 64.

Figure 9:
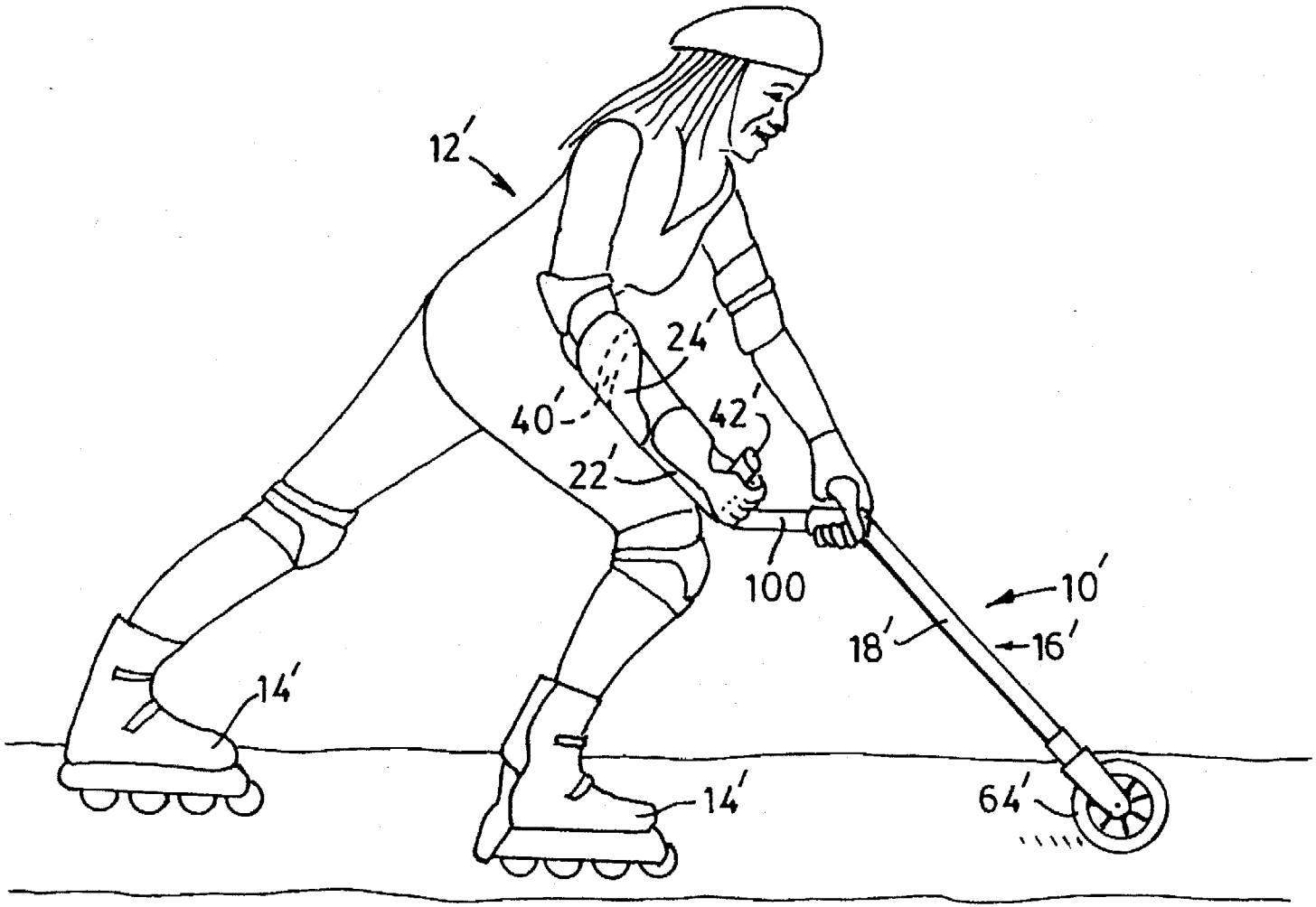
FIG. 9 is a side view of a skater using a mollified skate braking device according to the invention.
Figure 10:
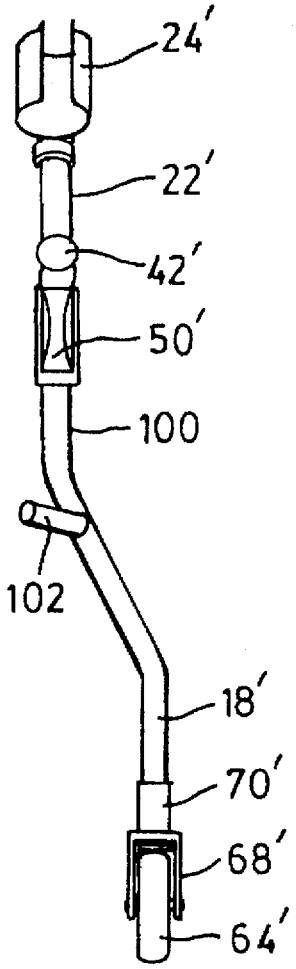
FIG. 10 is a front view of the modified device of FIG. 9.
Figure 11:
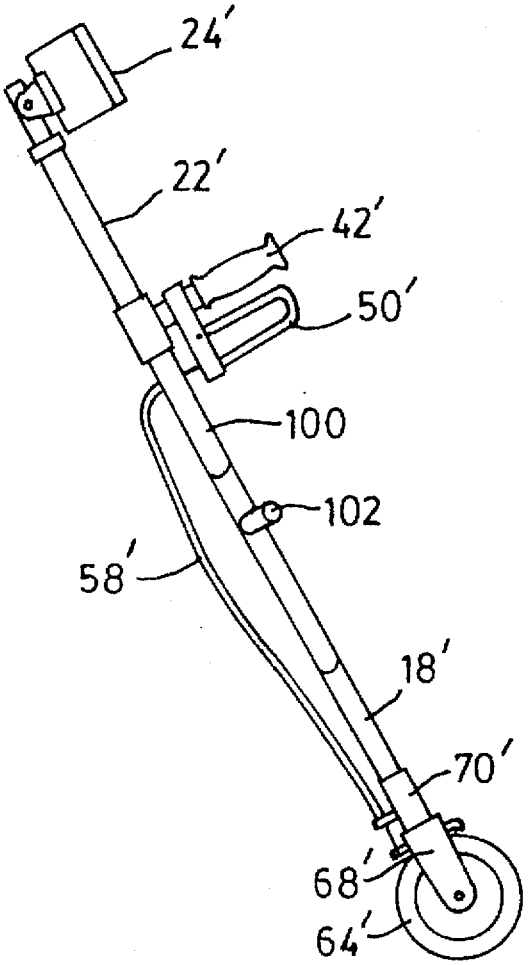
FIG. 11 is a side view of the modified device of FIG. 9.

In the embodiment described in connection with FIGS. 1 to 8, the shaft 16 is straight as viewed from the front. An alternative version is shown in FIGS. 9 to 11, in which primed reference numerals indicate parts corresponding to those of FIGS. 1 to 8. In the FIGS. 9 to 11 embodiment, the shaft 16 is generally S-shaped, having an angled central portion 100 between its upper and lower portions 22', 18'. The angled central portion 100 extends from the upper portion 22' toward-the center of the user's body. Therefore, for a right-handed person who attaches the device 10' to his/her right arm, the wheel 64' will be centered in front of the user's body, between his/her legs. This allows more stable triangulation and reduces the stresses on the user's right shoulder once the device has been grasped with both hands. It thus facilitates hard braking, as shown in FIG. 9. If desired, and as shown, the shaft 16 may include a second handle 102 projecting forwardly from the angled central portion 100, so that the user can grasp the second handle 102 with his/her free hand for additional support during emergency braking. A configuration with the center portion 100 extending in the opposite direction would be used for a left handed person. Alternatively, the second handle 102 may simply be a tubular grip around central portion 100.

Figure 12:
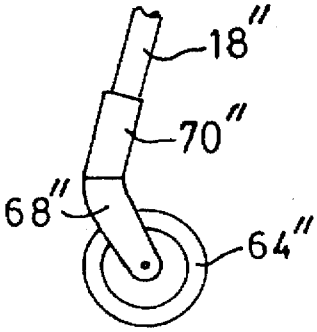
FIG. 12 is a side view of a modified arrangement for a device of the invention.

If desired, and as shown in FIG. 12 where double primed reference numerals indicate parts corresponding to those of FIGS. 1 to 8, the fork 68" can trail rearwardly from collar 70", so that bumps in the road surface will tend to lift the wheel 64" rather than being transmitted straight up the shaft and through the user's arm to the user's shoulder.

Figure 13:
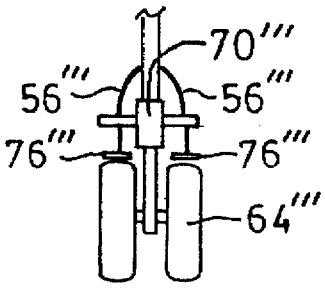
FIG. 13 is a front view of a further modified wheel arrangement for a device according to the invention.

A further modified arrangement is shown in FIG. 13 (where triple primed reference numerals are used), in which the single braking wheel 64 is replaced by dual wheels 64'''. (There will be a brake pad 76''' for each wheel, with the brake using wires 56''' being connected together so that both can be operated by one brake lever.) This offers additional stability and braking power, but at the cost of increased weight and bulk.

The size and nature of the braking wheel 64 will depend to some extent on the terrain which the skater is likely to negotiate. The wheel 64 should be large enough so that it does not catch in obstacles (e.g. railway tracks, sewer grates or the like) and therefore should not normally be smaller than about 2 inches in diameter. Preferably it is sufficiently large so that it will roll easily over most obstacles, since if it catches and is stopped, the skater could unexpectedly be thrust forwardly on it and fall over it, which would be undesirable. However if the wheel 64 is too large, the device becomes unattractive and is also heavier and bulkier. Therefore the wheel 64 will not normally exceed about 7 or 8 inches in diameter. A diameter range of 4 to 6 inches is preferred.

The wheel 64 may be made of various materials, e.g. soft rubber, hard rubber, plastic or the like.

It will be apparent that various additional changes may be made within the scope of the invention. For example the shaft 16 need not be telescopic but can be made to fit individual users. Various configurations may be used for the wheel or wheels 64, as desired. Various forms of commercially available braking mechanisms may be used, operating either on the tire or on the rim of the braking wheel.

In addition, if desired, the upper portion 22 of the shaft 16, and the arm holder 24, may be eliminated, so that the person simply firmly grips the handle 42 with one hand, and when braking is desired swings the other hand into position to grip the device with both hands. While this arrangement has the advantage that it reduces the size of the device 10, it is not preferred since in unexpected emergency stops where the skater has little or no warning that his/her skates are about to stop rolling, the skater's grip on the device may not be sufficiently strong to provide effective triangulation and support, and the skater may not have sufficient time to swing his/her other arm to grasp the device to provide a sufficient grip. The presence of the arm holder 24 essentially avoids this problem.

The device described may of course be made foldable or disassemblable, in any convenient manner.

While various embodiments of the invention have been described, it will be appreciated that further changes may be made within the scope of the invention.

I claim:

1. A device for supporting and braking a skater, said device comprising:

(a) an elongated body having an upper end and a lower end, (b) a wheel rotatably connected to said lower end, (c) braking means associated with said wheel for braking said wheel, (d) arm securing means located adjacent said upper end of said body for securing the skater's arm to said body, (e) hand grip means located below said arm securing means, and adapted to be gripped by the user's hand, (f) brake lever means located proximate said hand grip means and operable by said user's hand for activating said braking; and (g) said body has an upper portion having said upper end, a lower portion having said lower end, and a central portion connecting said upper and lower portions, said upper and lower portions being substantially parallel to each other as viewed from the front and said central portion being inclined with respect to said upper and lower portions and forming an S-shape therewith, so that, when said upper portion is secured to said skater's arm, said inclined central portion extends inwardly toward the center of the skater's body to position said wheel between the sides of the skater's body.

2. A device according to claim 1 wherein said brake lever means includes a portion adapted to be gripped and pulled by said skater's fingers while said skater's hand is on said hand grip means.

3. A device according to claim 1 wherein said arm securing means comprises a C-shaped holder having a pair of arcuate sides and an opening between said sides adapted to receive said skater's forearm.

4. A device according to claim 1 wherein said body comprises a tubular shaft.

5. A device according to claim 4 wherein said shaft is telescopically adjustable in length.

6. A device according to claim 1 and including second hand grip means connected to said central portion.

7. A device according to claim 6 wherein said second hand grip means extends forwardly from said central portion.

8. A device according to claim 1 wherein said lower end of said body includes a rearwardly extending portion, said wheel being mounted on said rearwardly extending portion.

* * * * *